US008276520B1

(12) United States Patent
Fong et al.

(10) Patent No.: US 8,276,520 B1
(45) Date of Patent: Oct. 2, 2012

(54) ADAPTIVE FRAGMENTATION MECHANISM TO ENHANCE LETHALITY

(75) Inventors: Richard Fong, Boonton Township, NJ (US); Peter Rottinger, Sussex, NJ (US); Henry Hsieh, Riverdale, NJ (US); Tom Blyskal, Edison, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 217 days.

(21) Appl. No.: 12/779,384

(22) Filed: May 13, 2010

(51) Int. Cl.
*F42B 12/22* (2006.01)

(52) U.S. Cl. ..... 102/493; 102/491; 102/492; 102/494

(58) Field of Classification Search ..... 102/491–497, 102/506, 389
See application file for complete search history.

(56) References Cited

U.S. PATENT DOCUMENTS

| | | | | | |
|---|---|---|---|---|---|
| 3,677,183 | A * | 7/1972 | Talley | 102/495 |
| 4,129,061 | A * | 12/1978 | Bedall et al. | 86/20.12 |
| H238 | H * | 3/1987 | Adams | 102/493 |
| 4,655,139 | A * | 4/1987 | Wilhelm | 102/494 |
| 4,662,281 | A * | 5/1987 | Wilhelm et al. | 102/494 |
| 4,664,035 | A * | 5/1987 | Osofsky | 102/493 |
| 4,781,117 | A * | 11/1988 | Garnett et al. | 102/493 |
| 5,540,156 | A * | 7/1996 | Fong | 102/476 |
| 6,186,070 | B1 * | 2/2001 | Fong et al. | 102/476 |
| 8,109,213 | B1 * | 2/2012 | Poulos et al. | 102/524 |
| 8,161,884 | B1 * | 4/2012 | Kokodis et al. | 102/493 |
| 2004/0011238 | A1 * | 1/2004 | Ronn et al. | 102/492 |
| 2006/0180045 | A1 * | 8/2006 | Ronn et al. | 102/492 |
| 2011/0179966 | A1 * | 7/2011 | Dupont et al. | 102/492 |

* cited by examiner

*Primary Examiner* — Michael David
(74) *Attorney, Agent, or Firm* — Michael C. Sachs

(57) ABSTRACT

A fragmentation warhead comprising manual selection means for generating larger fragments versus smaller fragments upon detonation. The warhead includes a generally cylindrically shaped fragmenting metal outer warhead within which lies a generally cylindrically shaped explosive charge. Cylindrically arranged ring mechanisms within the warhead may be rotated to select desired fragmentation patterns.

1 Claim, 8 Drawing Sheets

ADAPTIVE FRAGMENTATION MECHANISM TO ENHANCE LETHALITY

U.S. GOVERNMENT INTEREST

The inventions described herein may be made, used, or licensed by or for the U.S. Government for U.S. Government purposes.

BACKGROUND AND SUMMARY OF INVENTION

To destroy a specific target of a defined armor protection and size, a given fragmentation warhead must deliver a large number of optimally sized fragments within an effective lethal area. To combat multiple threat scenarios, the U.S. military must maintain supplies of several different fragmentation warheads, each type adapted for use against a particular target set. This obligatory approach creates a burden on logistics and supply. Additionally, existing artillery and mortars produce limited lethality depending upon the grade of steel used in their shells. Making more lethal, multi-purpose munitions available to the military would result in significant inventory reductions and cost savings. This invention is a high performance variable lethality, multi-purpose warhead using a novel adaptive fragmentation mechanism. This technology will enable the modern war fighter to instantly modify a fragmentation warhead in the field generating a desired fragment size to neutralize a broad range of targets from personnel to light armored vehicles. Additionally, adaptive fragmentation will minimize collateral damage by focusing the warhead's lethal effects upon the intended targets. The U.S. military employs fragmentation warheads against a wide variety of targets ranging from personnel, radar systems, trucks, parked aircraft, and rocket launchers to armored personnel carriers and self-propelled artillery. One significant obstacle to mission success is that a fragmentation warhead designed to defeat personnel is not generally effective against materiel targets including trucks and light armored vehicles, where fragments of relatively greater size and mass are required. Military units must maintain supplies of several different fragmentation warheads, each type adapted for use against a particular type of target. This results in a burden on logistics and supply. Existing artillery and mortars produce limited lethality depending upon the grade of steel used in their shells. Warhead designers have tried several techniques to enhance fragmentation including using harder High Fragmentation (HF) steel in the shell body, scoring the shell body, and adding preformed fragments. While these techniques can improve lethality, each traditional approach presents its own problems. Manufacturing HF steel involves a time consuming and costly heat treatment process. Scoring the casing weakens the shell's structural rigidity presenting potential problems related to survivability. Specifically, the scored grooves act as stress concentration points during the set back stage of gun launch. Adding preformed fragments helps to assure that the warhead delivers a few optimally sized fragments but it fails to enhance the fragmentation of the existing shell casing. To effectively engage multiple target types, the U.S. military requires an easily producible, multi-mode warhead alternative at a reasonable cost. By fitting conventional fragmentation warheads with relatively inexpensive, dynamically configurable patterned inserts to control the fragment mass distribution lethality can be increased. This new insert addresses the downfalls of the existing fragmentation enhancement methods because the insert requires no modifications to the existing projectile body; manufacturers can mass produce the simple insert parts for low cost using casting, stamping, or rolling methods and inexpensive materials including steel, copper, and plastics; and the insert can tailor the fragmentation masses and distribution for the best possible performance. For artillery, this ensures optimal lethality against both trucks and personnel and not just the latter. The dynamically configurable controlled fragmentation insert is effectively a patterned sleeve that fits inside the shell casing. The sleeve contains the cylinder of explosive material. The sleeve pattern is made up of rings stacked one on top the other. The individual rings can move independently of one another and a unique pinning mechanism holds the parts in a selected configuration. The war fighter can realign the insert parts by manipulating the fuse assembly to create different geometric patterns, each designed to engage a different target set with optimally sized fragments. Creating the effects of multiple linear shaped charges, the individual geometric shapes that make up the insert pattern focus the explosive energy released upon detonation to generate multiple high-velocity jets of insert material that cut up the steel shell casing in predefined areas. To engage enemy troops, the war fighter can deploy the warhead without changing the default mechanical offset of the insert pattern to produce smaller, lighter fragments with relatively higher velocities. To defeat materiel targets, the war fighter can easily "dial in" the insert pattern offset through the fuse assembly to configure larger fragments with greater penetrating power. Now, the war fighter can instantaneously configure one warhead in the field to engage multiple target types. This insert technique has enhanced capability with respect to fragmenting thick-walled, high-strength steel shells and has the unique patterned stacked ring configuration. It functions by forming jets of material, much like a linear shape charge. The jets cut into the shell body breaking it into smaller pieces. The patterned ring orientation, frequency, and geometric profiles can be modified to produce different combinations of large and small sized fragments. The sleeve can be made out of a variety of materials. Generally, denser and more ductile materials will perform the best but lower cost materials such as steel, copper, and plastic work too. Adaptive fragmentation benefits the modern war fighter because warhead engineers may retrofit existing projectiles using the multi-mode controlled fragmentation insert without modifying the shells. This new technology will also serve the U.S. military far into the future on grenades through mortar and artillery rounds up to tactical missiles. Additionally, future warhead designs could easily incorporate a mechanism to alter the fragmentation insert pattern in flight to adapt to rapidly changing battlefield conditions. For example, the war fighter could deploy a warhead configured to neutralize enemy personnel using smaller fragments and then remotely change the warhead's insert pattern in flight to defeat vehicles with larger fragments as the enemy combatants seek cover. The variable lethality warhead enhances the U.S. military's capabilities by optimizing lethality, minimizing collateral damage, enabling the military to multitask munitions to engage expanded target sets, reducing the costly burden on supply and logistics, and in that new warhead development can use lower cost, commonly available steels.

OBJECTS OF THE INVENTION

It is therefore an object of the present invention to provide fragmenting warhead means whereby a war fighter prior to a mission may manually be able to select relative size of fragments to be produced by the exploding warhead.

It is another object of the present invention to provide fragmenting warhead means having ring mechanisms therein whereby by selectively rotating various ring mechanisms inside the warhead, a war fighter might preselect to generate smaller fragment sizes to defeat personnel or larger fragment sizes to defeat light vehicles.

These and other objects, features and advantages of the invention will become more apparent in view of the within detailed descriptions of the invention and in light of the following drawings. It should be understood that the sizes and shapes of the different components in the figures may not be in exact proportion and are shown here for visual clarity and for purpose of explanation.

DESCRIPTION OF DRAWINGS

FIGS. 3A, 3B, 3D, 3F show several of the various ring mechanisms which might form a part of the warhead section as shown in FIGS. 2A and 2B, whereas

DETAILED DESCRIPTION

Figure 1:
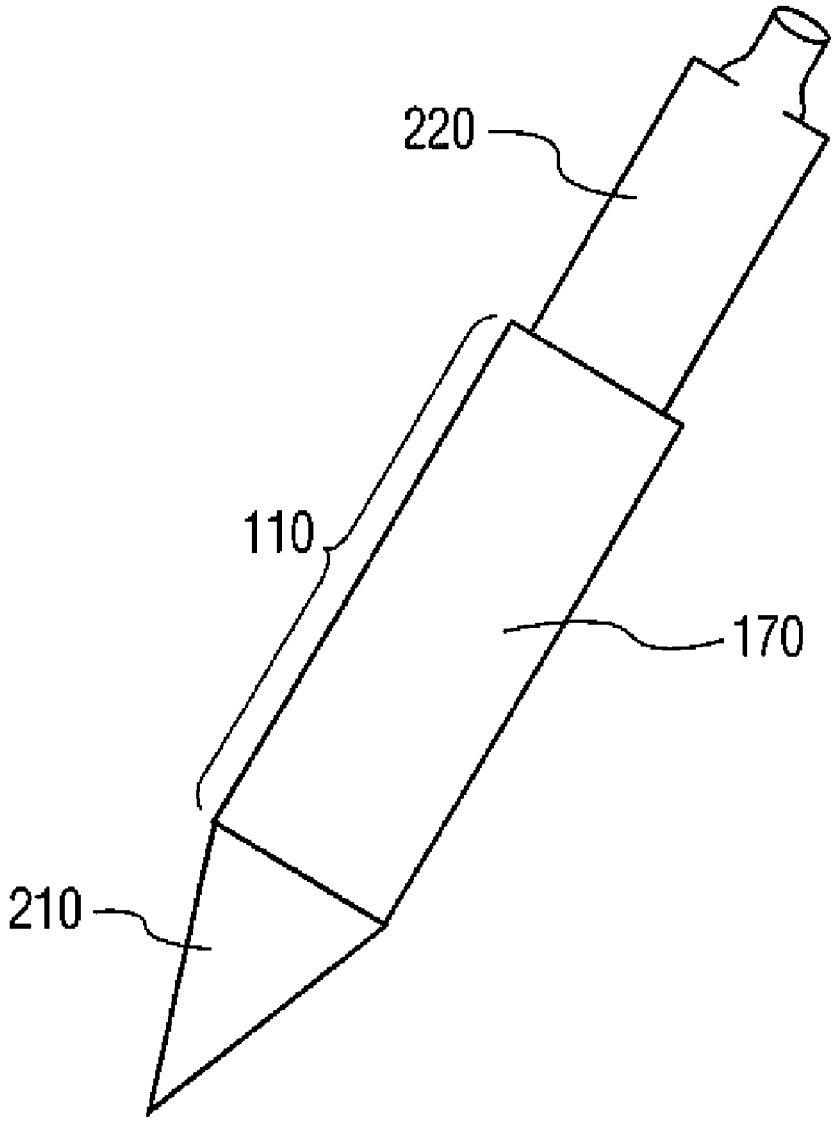
FIG. 1 shows an artillery round utilizing a generally cylindrically shaped fragmenting outer warhead disposed thereon in area 110 of the round.
Figure 2A:
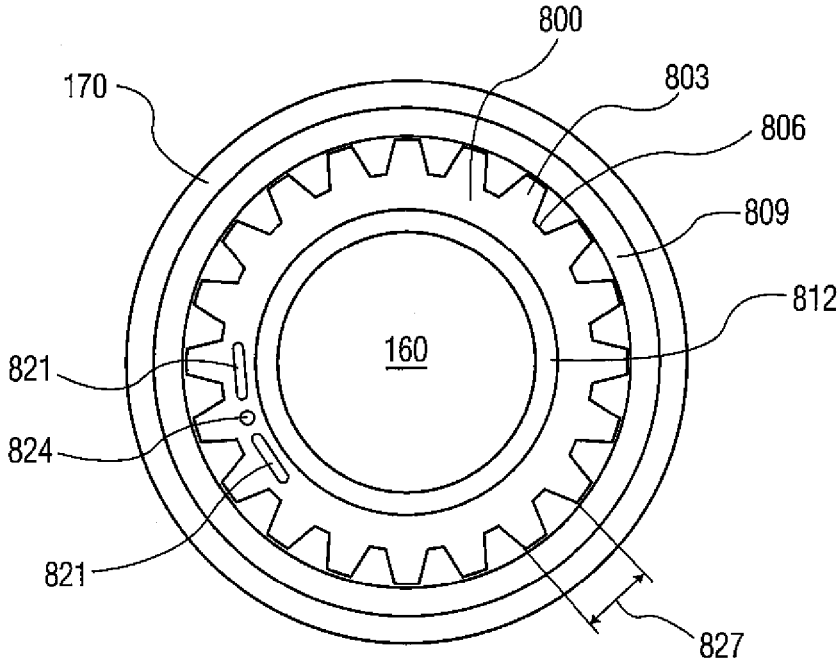
FIGS. 2A and 2B show, in two different embodiments, a cross-sectional view of the warhead section, in area 110 on the round of FIG. 1.
Figure 2B:
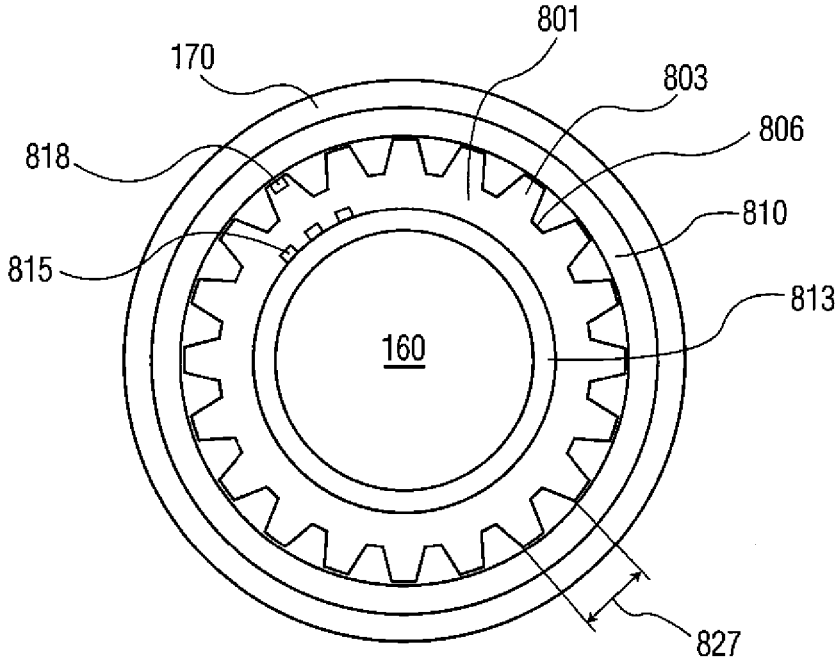
Figure 3A:
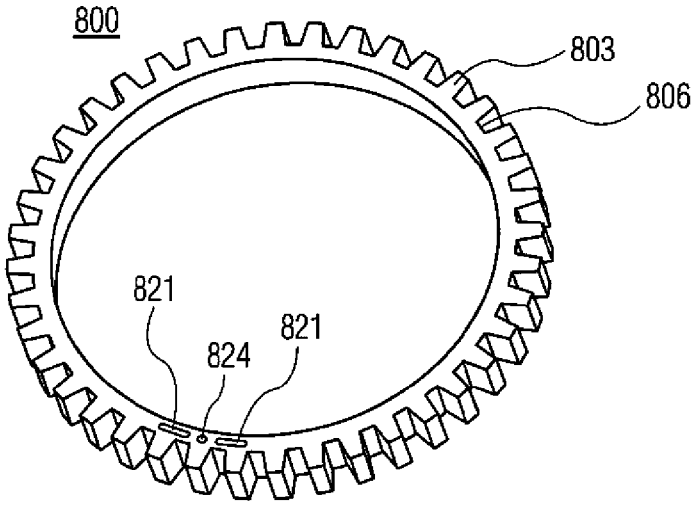
Figure 3B:
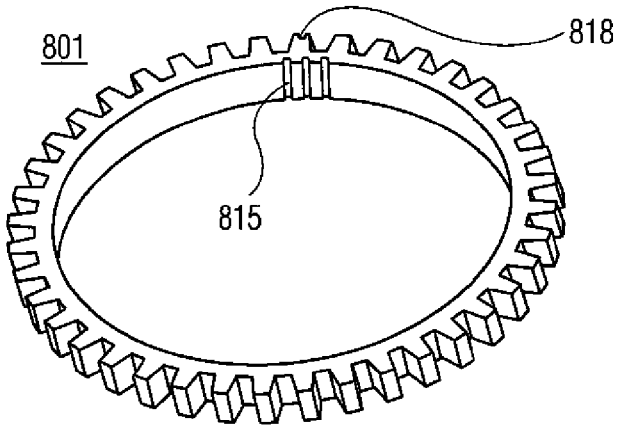
Figure 3C:
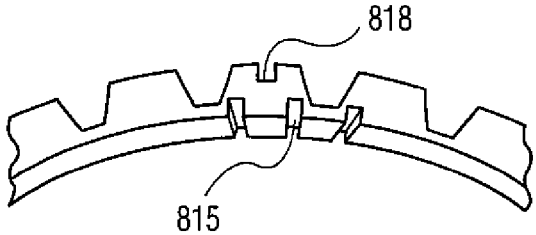
FIG. 3C shows a cutaway section of FIG. 3B.
Figure 3D:
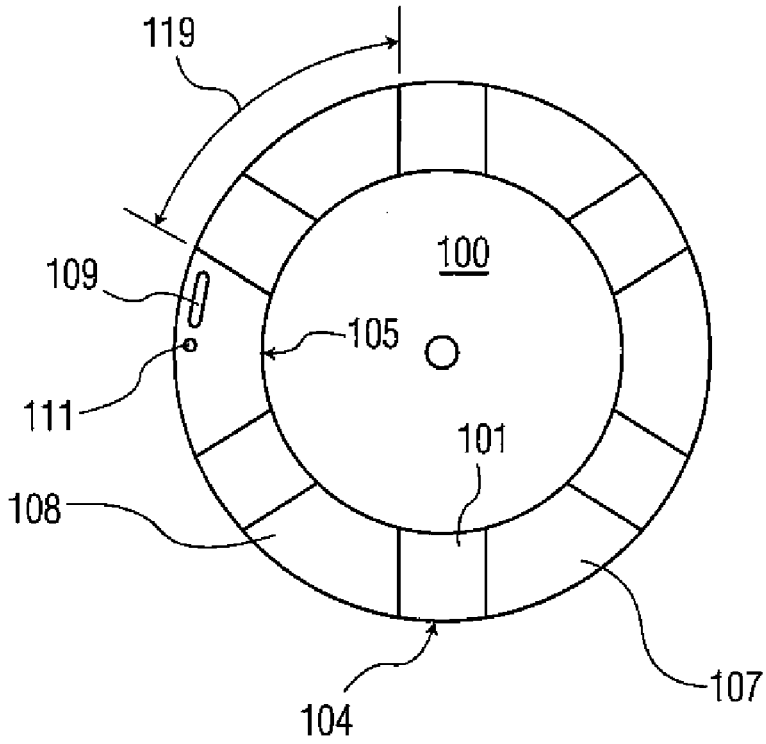
Figure 3E:
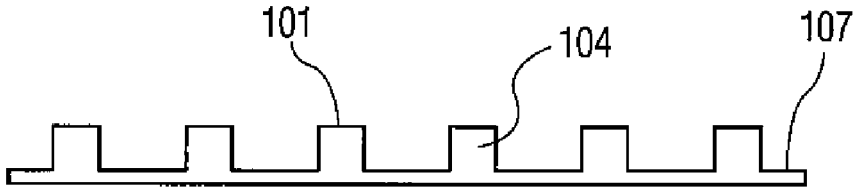
FIG. 3E shows a side view of ring mechanism 100 of FIG. 3D.
Figure 3F:
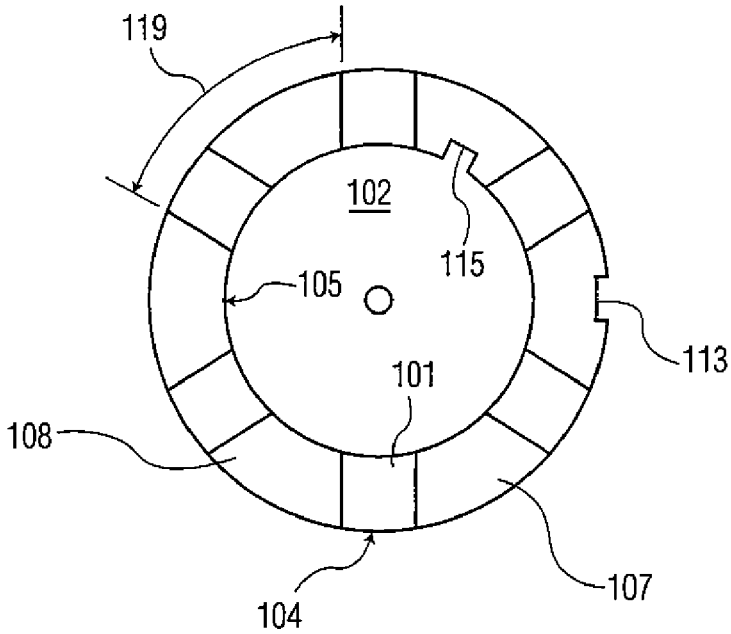
Figure 4:
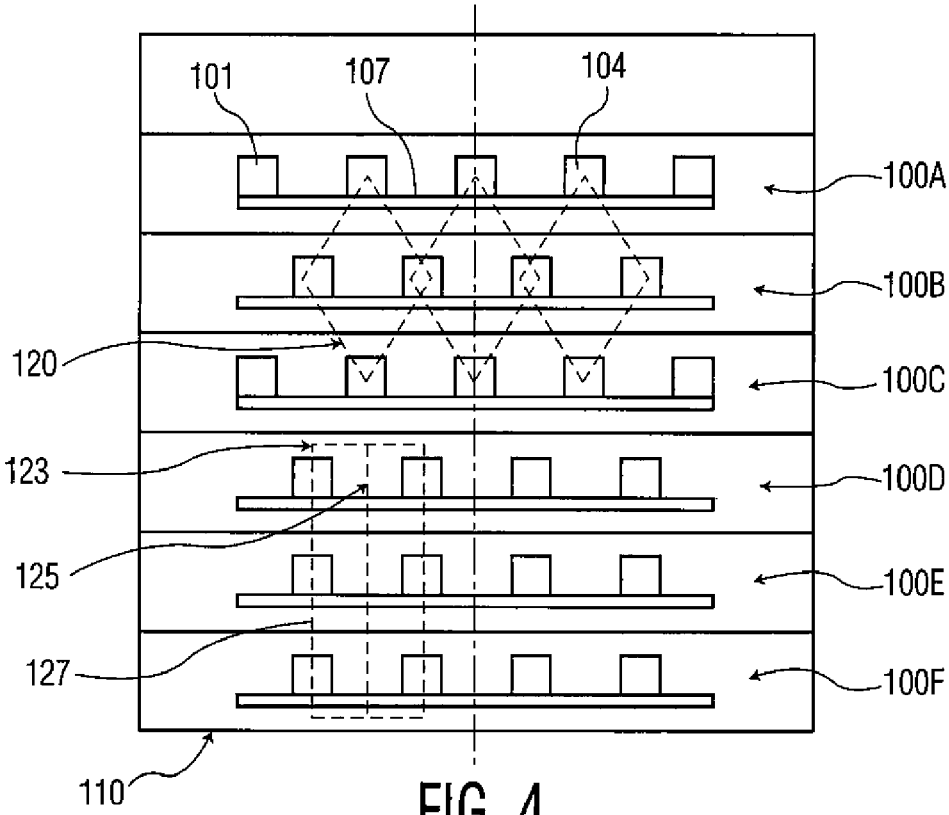
FIG. 4 shows a possible pattern of the outwardly looking faces of various blocks, of many stacked up ring mechanisms (100 or 102, as examples), to be located in the warhead section in area 110 of the round.
Figure 5:
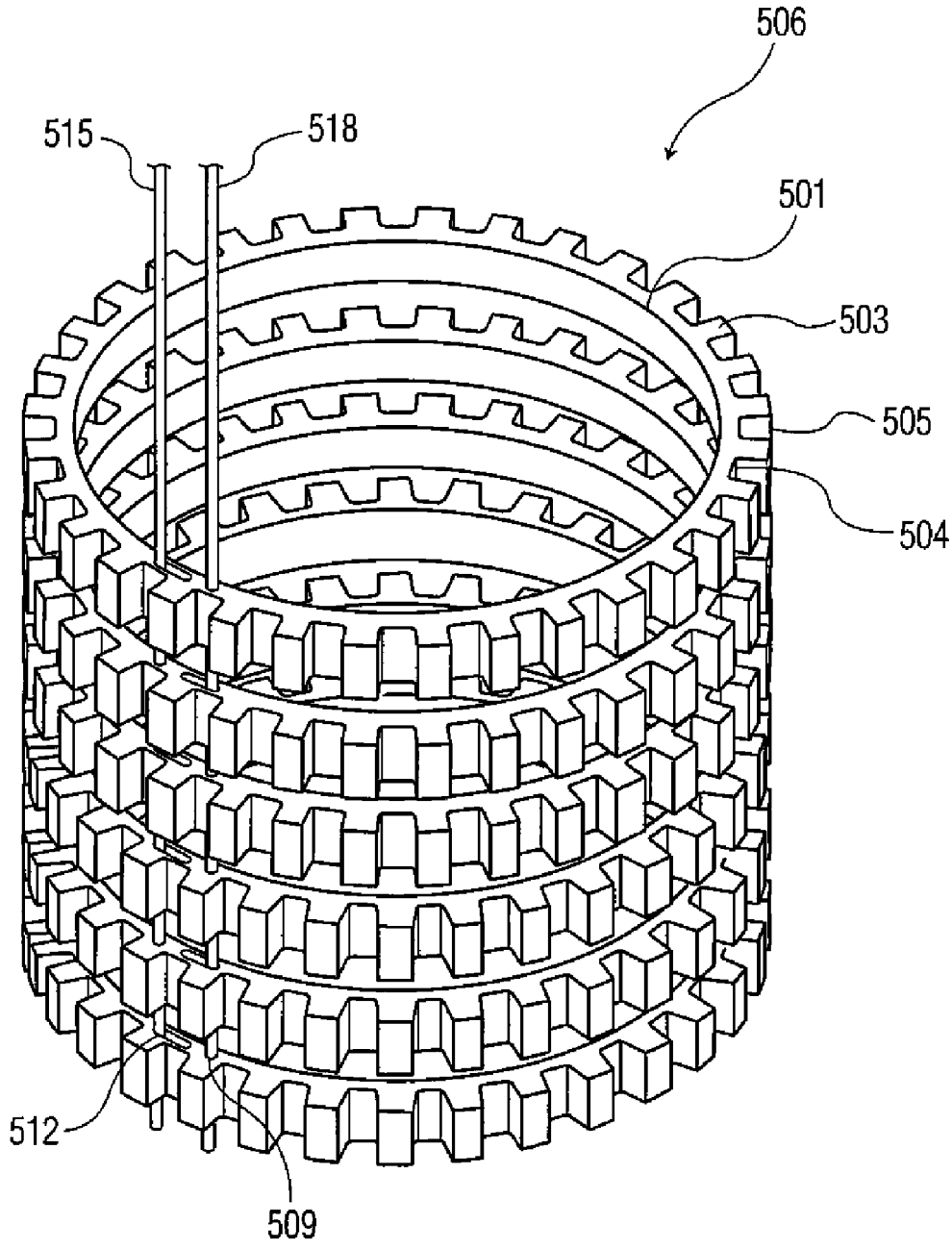
FIG. 5 shows an alternate design for stacking and positioning ring mechanisms, having cylindrical rings 501 with outwardly facing blocks 503 therein, and having dowels, holes, and slot mechanisms for forming a stack of positioned select such ring mechanisms, which can also be used in the warhead section of the round.
Figure 6:
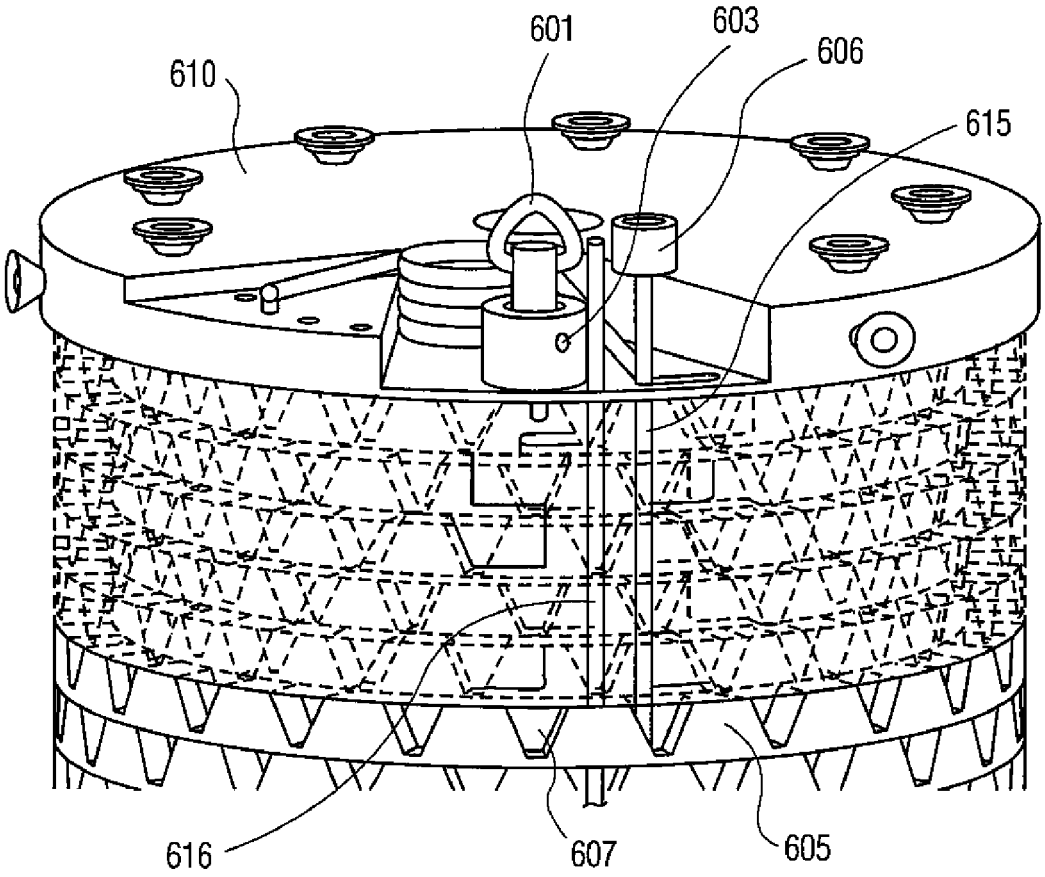
FIG. 6 shows an alternate design for stacking ring mechanisms having generally trapezoid shaped outwardly facing blocks thereon, and having spring mechanism 601 thereon to aid in holding the position of a stack of ring mechanisms in one of two selected positions, and pin means 601 thereon for locking in said position as selected.
Figure 7:
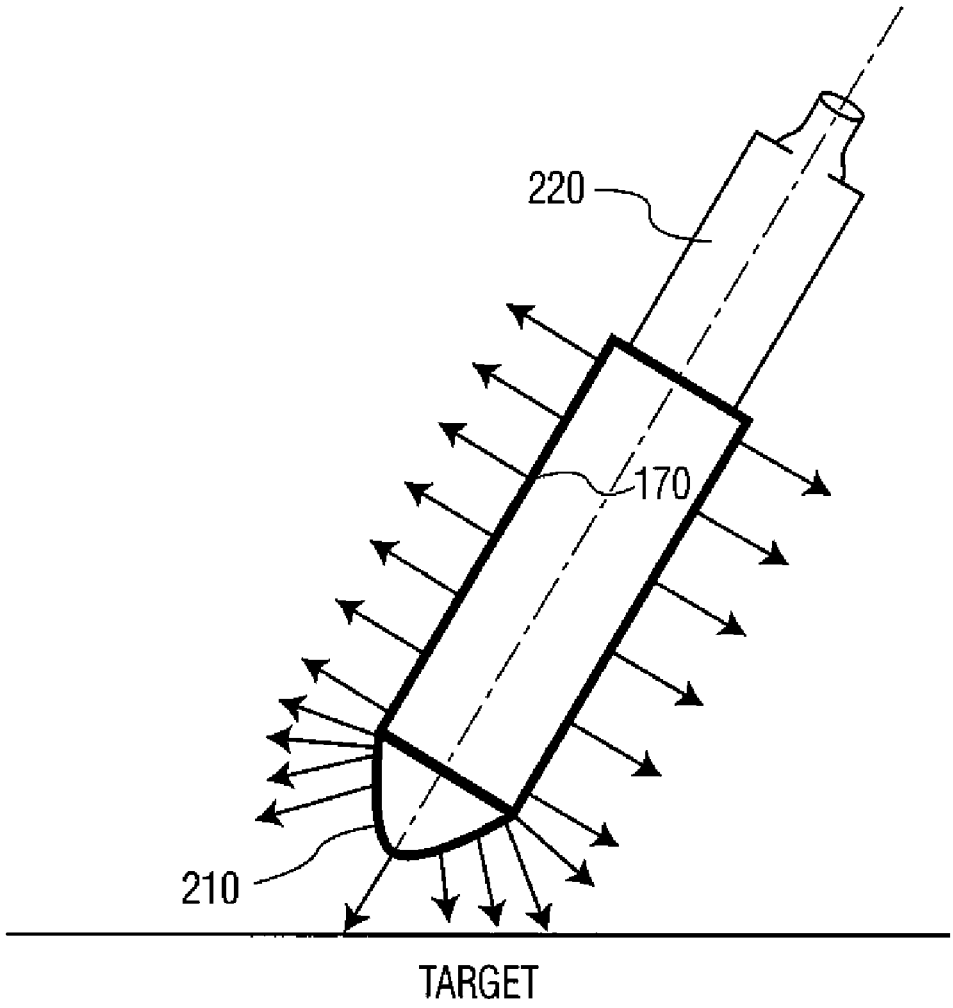
FIG. 7 shows the artillery round of FIG. 1 closing in to enter a target and as the warhead starts to explode.

FIG. 1 illustrates a typical projectile meant to deploy a cylindrical shaped fragmenting outer warhead according to this invention. The fragmenting outer warhead 170 is disposed in an area bracketed as 110 on the projectile. The projectile typically has a nose cone area 210 also including guidance, and a propulsion area 220 including a propulsion means. The fragmenting outer warhead typically sprays fragments radially outward however as shown in FIG. 7, there is also a forward outwardly conically shaped fragment spray into the direction of the target, moreover hopefully the projectile will have well closed in even began to enter the target before the fragmenting outer warhead begins to explode. FIGS. 2 and 2A show a cross section of the overall fragmenting warhead mechanism. The outer part of the warhead mechanism is cylindrically shaped fragmenting outer warhead 170. At the core, there is a solid explosive charge 160, cylindrically shaped, and typically coaxial to the fragmenting outer warhead 170. The explosive charge 160 may comprise the warhead example, LX-14, OCTOL, hand packed C-4, or any other solid explosive, that can be machined, cast, or hand-packed to fit snugly within the inside of the warhead, as illustrated. Immediately surrounding the explosive is hollow cylindrically shaped first inner liner (812 in FIGS. 2A and 813 in FIG. 2B), which may be manually rotated around, and is coaxial with, the explosive component 160. There is also a like, coaxial, second inner liner (809 in FIGS. 2A and 810 in FIG. 2B), which is immediately disposed inside the fragmenting outer warhead 170, and which is usually stationary. Between the inner and outer liners are a number of stacked identical circular ring mechanisms (800 in FIG. 2A, 801 in FIG. 2B, 100 in FIG. 3D, or 102 in FIG. 3E), all coaxial to the explosive 160, to the liners (809, 810, 812 or 813, as the case may be), and to the outer warhead 170. These ring mechanisms may be stationary or else capable of being rotated about with respect to the liners (809, 810, 812 or 813, e.g.). Each end of the fragmenting outer warhead 170 has end plates (not shown here) to hold in place the stacked circular ring mechanisms as well as the other parts of the warhead mechanism, the explosive and the liner components. One type ring mechanism 800, 801 is shown in FIGS. 2A, 2B. This is an annular ring shape, which resembling a gear, has trapezoidal shaped blocks around its outer circumference. Another type ring mechanism 100, 102 is shown in FIG. 3D or 3F. A planar, flat, relatively thin ring 107 is integral with a multiplicity of like material three dimensional essentially rectangularly shaped blocks 101 which are positioned equidistantly on one face of, and around the circumference of, the flat ring 107. (In actuality, the blocks 101 are curved on their outer looking faces 104 and inner looking faces 105 to agree with the ring curvature). The material may be steel, brass, copper, aluminum, plastic, or other possible materials that would be successful as "cutter" materials that interfere with the jet of the explosively formed projectile molten jet from the exploded core during detonation. The warhead can be used for 40 mm, 105 mm, or 120 mm, or other size projectiles, for artillery as well as for mortar applications, and possibly for mines and grenades as well, where there is a fragmentation warhead involved. The warhead may also have application to the 105 mm STAR ATO round (Selectable Technology for Adaptive Response, Army Technical Objective) and also to multifunctional airburst, hardened penetrator, anti-personnel, anti-materiel, insensitive munitions, and insensitive blast warheads. Between the blocks are open areas 108 which are thus also positioned equidistantly around the circumference of ring 107, (interspersed by the blocks 101). Each block has an outward looking face 104 and an inward looking face 105. In FIG. 4 there is a side view of the stacked up ring mechanisms (100 or same for 102) when positioned in area 110 on the warhead. Each ring mechanism 100 shown is capable of being individually positioned by rotating the ring mechanism coaxially with respect to an adjacent ring mechanism, or ring mechanisms. Adjacent ring mechanisms 100A, 1008, 100C, e.g., might be positioned where the outer faces 104 are in a checkerboard pattern, as shown by the diamond shaped dashed lines 120, or adjacent ring mechanisms 100D, WOE, 100F, e.g., might be positioned where the outer faces 104 are in a straight line pattern, as shown by the rectangular shaped dashed lines 123. In the straight line pattern, large fragments may ultimately result (through breakage of the fragmenting outer warhead 170) traceably caused by having (open) contiguous areas such as shown by dashed lines 125. Here, the detonated explosive shock wave has an open path (except for the negligibly thin edged bit of ring 107) straight to the interior of the fragmenting outer warhead 170. However, in non contiguous areas such as shown by dashed lines 127, only shreds (or possibly very small assorted sized fragments) may ultimately result through breakage of the fragmenting outer warhead 170 traceably caused by having those 127 non contiguous areas. This is because, in 127, the detonated explosive shock wave path is well interfered with by the presence of these blocks 101. The checkerboard pattern illustrated by the positioning of ring mechanisms 100A, 100B, 100C, however, should result in more or less uniform sized small fragments. The patterns, such as the checkerboard, are selectively chosen by clocking the entire device, clockwise rotation, which will allow some of the ring mechanisms to rotate, but not all of them, as will be explained. Ring mechanisms desired to be held in place so they cannot rotate with respect to one another can be joined by running a dowel rod (not shown here) through the holes (111 in FIG. 3D, 824 in FIG. 3A, e.g.), of each such ring mechanisms desired to be held in place, whereas for those other ring mechanisms not desired to be so joined, the dowel would go through slots (109 in FIG. 3D, 821 in FIG. 3A, e.g.), also available on each ring mechanism. The ring mechanisms where the dowel only goes through a slot, can therefore in theory be rotated the full length of a slot (109, 821, e.g.), as desired. The ring mechanism 800 has two slots 821 on it, to give the advantage of being able to turn over a ring mechanism 800 and still be used since it has a slot 821 on either side of the hole 824 (two or more holes 824, or more slots can be put on each ring mechanism 800 for more such flexibility). The length of a slot should thus be less than the distance 119 between blocks 101 in FIG. 3D, e.g., (827 in FIGS. 2A, 2B) and probably about half such distance 119 (or 827 as the case might be). By rotating (only slotted) rings one could create a desired pattern for area 110, such as a checkerboard, e.g., spring mechanisms (not shown here) could be used to hold various ring mechanisms (with dowel only in a slot 109, 821, e.g.) in one default position, unless moved manually and then locked into a new desired position. This will be seen to permit manual selection of desired fragment sizes by a soldier prior to a mission. The device might employ three or four sections, each having three ring mechanisms each, which are arranged in patterns that the soldier may select, as mentioned, by clocking the entire device, clockwise rotation, which will allow some of the ring mechanisms to rotate, but not all of them. In a second mode for arranging the ring mechanisms, alternatively, first liner means 813 also has (on its exterior surface), outwardly projecting pins meant to mate with slots such as 115 on the interior circumference of ring 107 (or slots 815 on the interior circumference of ring 801), whereas second liner means 810 also has (on its interior surface), inwardly projecting pins meant to mate with slots such as 818 on the exterior circumference of select ring mechanisms of 801 (or slots such as 113 on the exterior circumference of select ring mechanisms of 102). These will be seen to be a second way (as distinguished from the dowels+holes+slots approach) to ensure locking in place, or rotation of, various select ring mechanisms (of 801, 102) with respect to the other ring mechanisms. Rotation of the first liner means will cause rotation of select ring mechanisms (of 801, 102) as may be desired, whereas other ring mechanisms (of 801, 102) which do not contact mating pins on the first liner means will not move. Ring mechanisms (of 801, 102) not intended to be moved, to the contrary, are locked in place to the stationary, second liner means by appropriate mating pins on the second liner means. FIG. 5 shows an arrangement of stacked ring mechanisms 501. Here, the blocks 503 (analogous perhaps to teeth on a large gear) are integrally attached on the outside surface of a circular ring 501. The blocks each have an outward looking rectangular face 505, and shallow areas 504 equally interspersed between each block. The cross section of each block 503, (if cut in the plane of the ring mechanism), would be trapezoidal in shape. In another embodiment shown in FIG. 6, the outward looking end face of each block 605 and the notch areas 607 are trapezoidal in shape, the notch areas are only about a third as wide as the faces 605, and the cross-sectional shape of a block in the plane of a ring mechanism would be rectangular, and the blocks are integral to the ring; other shapes for these blocks are of course possible. Each ring mechanism 501 has a slot 512 as well as a hole 509. The free movement of certain ring mechanisms may be entirely joined to one another by running a first dowel rod 518 through the hole(s) of 509 of those ring mechanisms 501 desired to be joined. A second dowel rod 515 may be run through all the slot(s) 512 on all the other ring mechanisms in this stack. The slot(s) 512 allow rotation of these other ring mechanisms within the length of these slots. This may be controlled to have only two possible positions for these other ring mechanisms which can be selected through rotation in these slot(s) as shown in FIG. 6. There included is a mechanical interface required to position and secure the different ring alignment configurations. The mechanism consists of two dowel rods that extend the full length of the device. Each patterned ring mechanism is fabricated with both one slot and one hole. The dowel rods are inserted through each ring into either a hole or slot. In operation, these rods can be held into one of two modes through the use of a spring mechanism 601. By assembling the warhead in this way, moving the rods together results in one alignment while moving the rods apart allows for a second alignment (which result in either smaller or larger fragment sizes upon detonation). The order in which the rings are stacked onto the rods, the location of the holes and slots in each ring, and the positions of the rods in the holes and slots will determine the alignment of the pattern formed by the rings and the resulting fragmentation modes. The fragmentation mode of the warhead can be selected through the fuse assembly using a locking mechanism. The default mode, possibly small fragmentation, is set by compressing the spring thereby moving the rods together, and then locking this position with a locking pin 601. The fuse assembly can be configured to release the locking mechanism (by pulling pin 601, e.g.) while the projectile is in flight or at pre-launch. This allows the spring to push the rods apart resulting in an alternate ring alignment and a secondary fragmentation mode. The two selected positions for example, might be to choose for smaller fragments or for larger fragments. Lining up a row of blocks in a stack of ring mechanisms, in a straight line for example, would more likely result in larger fragments as was explained earlier. All this would be done mechanically by spring action, as was also explained.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A fragmentation warhead comprising manual selection means for generating larger fragments versus smaller fragments upon detonation, said warhead comprising:

a cylindrically shaped fragmenting outer warhead;

a cylindrically shaped explosive charge;

a cylindrically shaped first inner liner coaxial with, the explosive charge;

a cylindrically shaped second inner liner disposed immediately inside the fragmenting outer warhead;

between the inner and outer liners are a number of stacked identical circular ring mechanisms all coaxial to the explosive charge, to the liners and to the outer warhead;

said ring mechanisms each having a planar thin ring integral with a multiplicity of like material three dimension rectangular shaped blocks which are positioned equidistantly on one face of, and around the circumference of said ring, equidistant with open areas between the blocks around the circumference of said ring;

and wherein each ring mechanism is capable of being individually positioned by rotating the ring mechanism coaxially with respect to another ring mechanism or ring mechanisms so that the outer faces on the blocks appear in an outwardly looking checkerboard pattern to form smaller size fragments upon detonation of the warhead;

and wherein each ring mechanism is capable of being individually positioned by rotating the ring mechanism coaxially with respect to another ring mechanism or ring mechanisms so that the outer faces on the blocks appear in an outwardly looking straight line pattern to form larger size fragments upon detonation of the warhead;

and wherein selected ring mechanisms variously desired to be held stationary to form a desired block pattern to one another can be joined by a rod through holes and slots in each ring mechanism; and a spring mechanism to hold various ring mechanisms in one default position unless moved manually and then locked into a new desired position.

* * * * *